US006716123B1

(12) United States Patent
Chen

(10) Patent No.: US 6,716,123 B1
(45) Date of Patent: Apr. 6, 2004

(54) NET SUPPORT RACK ASSEMBLY

(76) Inventor: Michael Chen, No. 1, Alley 16, Lane 40, Jinh Te Road, Taichung (TW)

( * ) Notice: Subject to any disclaimer, the term of this patent is extended or adjusted under 35 U.S.C. 154(b) by 0 days.

(21) Appl. No.: 10/349,633

(22) Filed: Jan. 20, 2003

(51) Int. Cl.[7] ..... A63B 61/04
(52) U.S. Cl. ..... 473/490; 473/492
(58) Field of Search ..... 473/490, 491, 473/492, 493, 494

(56) References Cited

U.S. PATENT DOCUMENTS 3,195,898 A * 7/1965 Respini ..... 473/197
3,649,011 A * 3/1972 Barnes ..... 473/494
4,274,632 A * 6/1981 Jacobs ..... 473/492
5,269,533 A * 12/1993 Kellams ..... 473/492
5,333,880 A * 8/1994 Allbright ..... 473/493
5,816,956 A * 10/1998 Ellis et al. ..... 473/490

* cited by examiner

*Primary Examiner*—Raleigh W. Chiu

(57) ABSTRACT

A net support rack assembly comprising two connectors, two longitudinal tubes, four transverse tubes, two elastic cords, two bottom tubes, two first connecting tubes, a second connecting tube, a net, an elastic lock, and two clamping members. Thus, the net is fully stretched and expanded on the two longitudinal tubes by the elastic force of the elastic lock. In addition, each of the two longitudinal tubes, each of the two connectors, each of the two bottom tubes, each of the two first connecting tubes and the second connecting tube are closely combined with each other by the elastic force of the elastic lock.

5 Claims, 7 Drawing Sheets

NET SUPPORT RACK ASSEMBLY

BACKGROUND OF THE INVENTION

1. Field of the Invention

The present invention relates to a net support rack assembly, and more particularly to a net support rack assembly which is assembled and folded easily and conveniently.

2. Description of the Related Art

A conventional net support rack is disclosed in U.S. Pat. No. 5,816,956, entitled "NET SUPPORT STRUCTURE". However, the net is mounted on the frame by its four ends, so that the mounting structure between the net and the frame is weak. In addition, the main body has a greater length, so that it is easily bent and deformed during a long-term utilization.

SUMMARY OF THE INVENTION

The present invention has arisen to mitigate and/or obviate the disadvantage of the conventional net support rack.

The primary objective of the present invention is to provide a net support rack assembly, wherein the snapping end of the elastic lock is snapped into and locked in the hooking groove of the net, so that the net is fully stretched and expanded on the two longitudinal tubes by the elastic force of the elastic lock.

Another objective of the present invention is to provide a net support rack assembly, wherein each of the two longitudinal tubes, each of the two connectors, each of the two bottom tubes, each of the two first connecting tubes and the second connecting tube are closely combined with each other by the elastic force of the elastic lock.

A further objective of the present invention is to provide a net support rack assembly, wherein each of the transverse tubes is closely mounted on a respective one of the two connectors by the elastic force of each of the two elastic cords.

A further objective of the present invention is to provide a net support rack assembly, wherein each of the two clamping members is movably mounted on the bottom tube to provide a positioning effect, thereby preventing the bottom tube or the main body of the net support rack assembly from being bent or deformed during a long-term utilization.

In accordance with the present invention, there is provided a net support rack assembly comprising two connectors, two longitudinal tubes, four transverse tubes, two elastic cords, two bottom tubes, two first connecting tubes, a second connecting tube, a net, and an elastic lock, wherein:

- each of the two connectors has a hollow inside and has four ends each formed with a through hole;
- each of the two longitudinal tubes has a lower end inserted into the through hole of a first end of a respective one of the two connectors;
- each of the four transverse tubes has a first end inserted into the through hole of either one of second and third ends of a respective one of the two connectors;
- each of the two elastic cords is extended through the through hole of each of the second and third ends of a respective one of the two connectors, and has two ends each secured on a second end of a respective one of the four transverse tubes, so that the first end of each of the four transverse tubes is closely mounted in the through hole of either one of the second and third ends of a respective one of the two connectors by the elastic force of each of the two elastic cords;
- each of the two bottom tubes has a first end inserted into the through hole of a fourth end of a respective one of the two connectors;
- each of the two first connecting tubes has a first end connected to a second end a respective one of the two bottom tubes;
- the second connecting tube has two ends each connected to a second end a respective one of the two first connecting tubes;
- the net has two sides each formed with an enclosure to enclose a respective one of the two longitudinal tubes; and
- the elastic lock is extended through each of the two longitudinal tubes, each of the two connectors, each of the two bottom tubes, each of the two first connecting tubes and the second connecting tube, so that each of the two longitudinal tubes, each of the two connectors, each of the two bottom tubes, each of the two first connecting tubes and the second connecting tube are combined with each other by the elastic force of the elastic lock.

Further benefits and advantages of the present invention will become apparent after a careful reading of the detailed description with appropriate reference to the accompanying drawings.

DETAILED DESCRIPTION OF THE INVENTION

Figures 1, 1A:
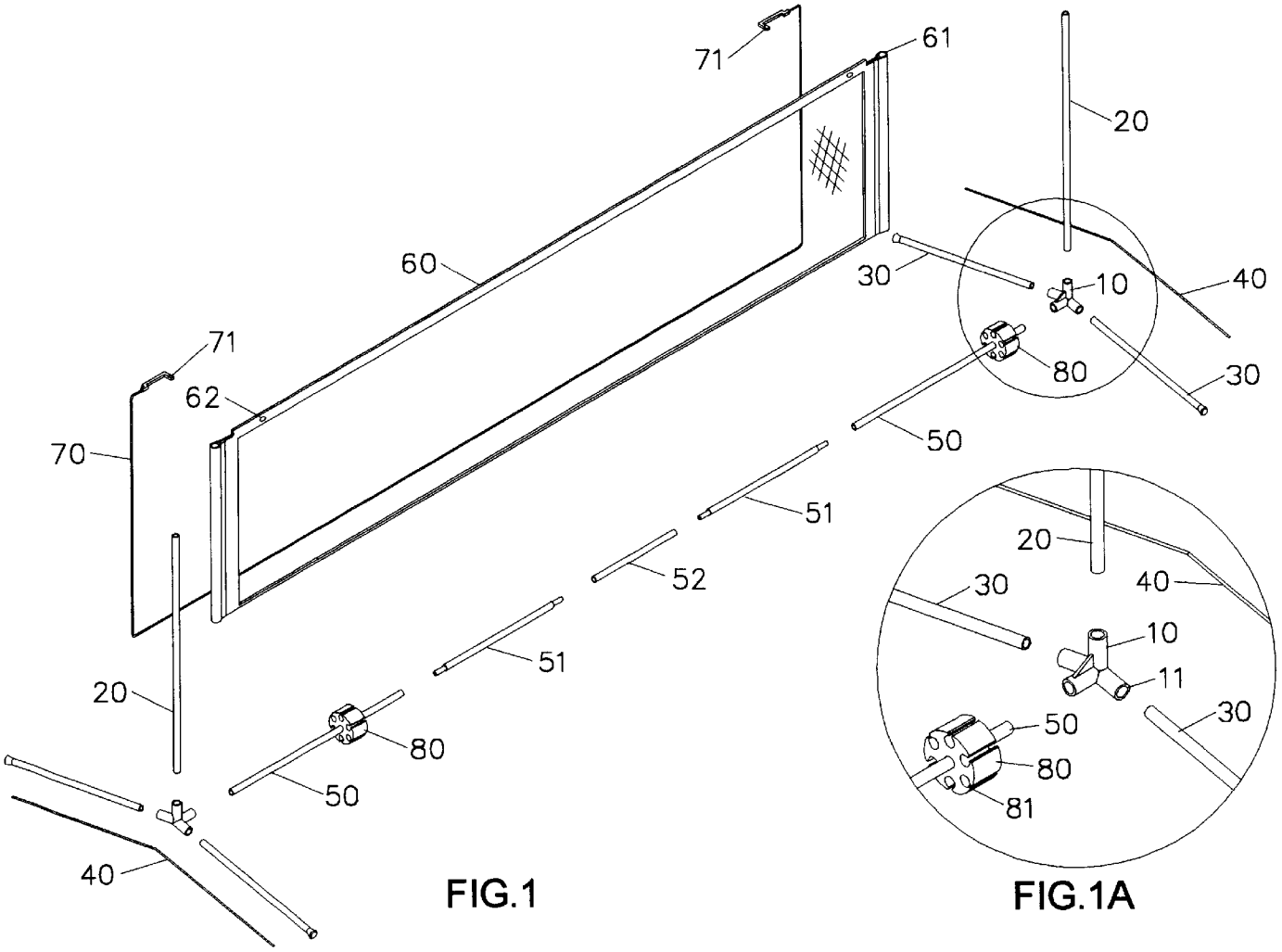
FIG. 1 is an exploded perspective view of a net support rack assembly in accordance with a first embodiment of the present invention.
FIG. 1A is a partially enlarged view of the net support rack assembly as shown in FIG. 1.

Referring to the drawings and initially to FIGS. 1 and 1A, a net support rack assembly in accordance with a first embodiment of the present invention comprises two connectors 10, two longitudinal tubes 20, four transverse tubes 30, two elastic cords 40, two bottom tubes 50, two first connecting tubes 51, a second connecting tube 52, a net 60, an elastic lock 70, and two clamping members 80.

Each of the two connectors 10 has a hollow inside and has four ends each formed with a through hole 11.

Each of the two longitudinal tubes 20 has a lower end inserted into the through hole 11 of a first end of a respective one of the two connectors 10.

Each of the four transverse tubes 30 has a first end inserted into the through hole 11 of either one of second and third ends of a respective one of the two connectors 10.

Each of the two elastic cords 40 is extended through the through hole 11 of each of the second and third ends of a respective one of the two connectors 10, and has two ends each secured on a second end of a respective one of the four transverse tubes 30, so that the first end of each of the four transverse tubes 30 is closely mounted in the through hole 11 of either one of the second and third ends of a respective one of the two connectors 10 by the elastic force of each of the two elastic cords 40.

Each of the two bottom tubes 50 has a first end inserted into the through hole 11 of a fourth end of a respective one of the two connectors 10.

Each of the two first connecting tubes 51 has a first end connected to a second end a respective one of the two bottom tubes 50.

The second connecting tube 52 has two ends each connected to a second end a respective one of the two first connecting tubes 51.

The net 60 has two sides each formed with an enclosure 61 to enclose a respective one of the two longitudinal tubes 20 and each formed with a hooking groove 62.

The elastic lock 70 is extended through each of the two longitudinal tubes 20, each of the two connectors 10, each of the two bottom tubes 50, each of the two first connecting tubes 51 and the second connecting tube 52, so that each of the two longitudinal tubes 20, each of the two connectors 10, each of the two bottom tubes 50, each of the two first connecting tubes 51 and the second connecting tube 52 are combined with each other by the elastic force of the elastic lock 70. The elastic lock 70 has two ends each formed with a snapping end 71 snapped into the hooking groove 62 of the net 60. The snapping end 71 of the elastic lock 70 has a size slightly greater than an inner diameter of each of the two longitudinal tubes 20.

Each of the two clamping members 80 is mounted on a respective one of the two bottom tubes 50, and is formed with a plurality of clamping recesses 81.

Figure 2A:
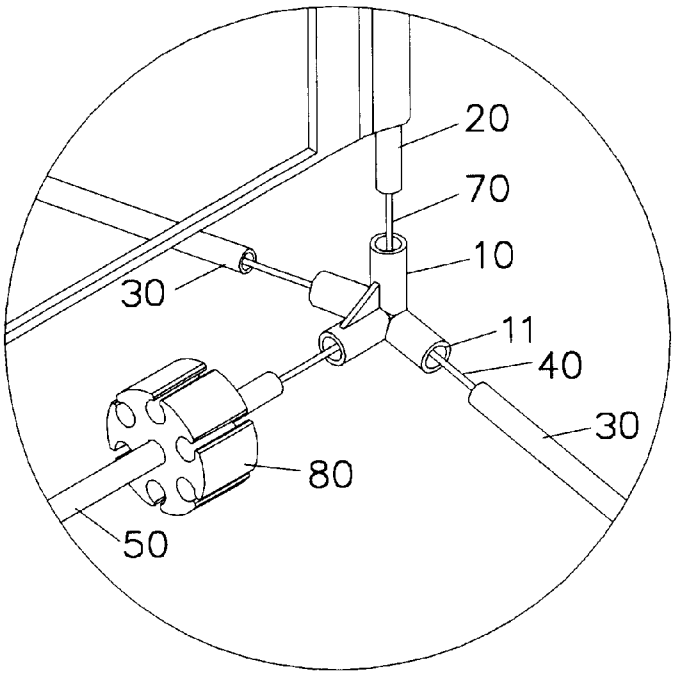
FIG. 2A is a partially enlarged view of the net support rack assembly as shown in FIG. 2.
Figure 2:
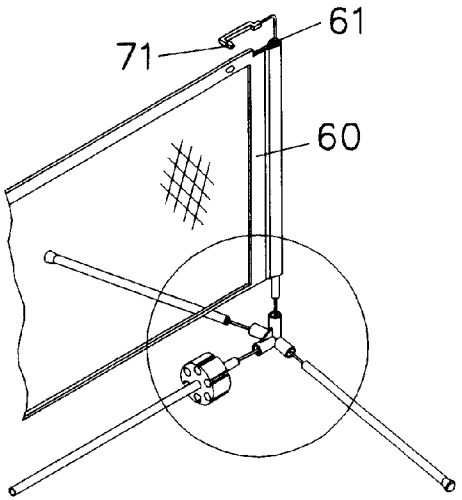
FIG. 2 is a partially assembly view of the net support rack assembly as shown in FIG. 1.

In assembly, referring to FIGS. 2 and 2A with reference to FIGS. 1 and 1A, each of the two elastic cords 40 is extended through the through hole 11 of each of the second and third ends of a respective one of the two connectors 10, and has two ends each secured on the second end of a respective one of the four transverse tubes 30, so that the first end of each of the four transverse tubes 30 is closely mounted in the through hole 11 of either one of the second and third ends of a respective one of the two connectors 10 by the elastic force of each of the two elastic cords 40. In addition, the elastic lock 70 is extended through each of the two longitudinal tubes 20, each of the two connectors 10, each of the two bottom tubes 50, each of the two first connecting tubes 51 and the second connecting tube 52, so that each of the two longitudinal tubes 20, each of the two connectors 10, each of the two bottom tubes 50, each of the two first connecting tubes 51 and the second connecting tube 52 are combined with each other by the elastic force of the elastic lock 70.

Figure 3A:
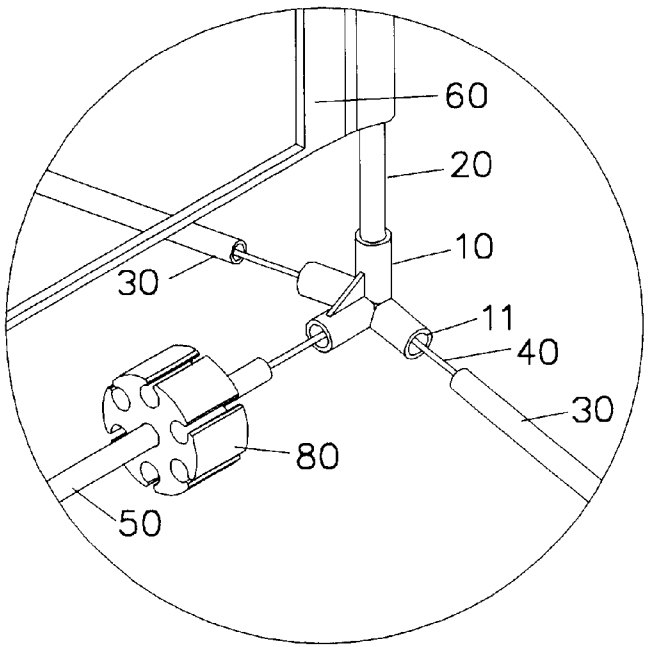
FIG. 3A is a partially enlarged view of the net support rack assembly as shown in FIG. 3.
Figure 3:
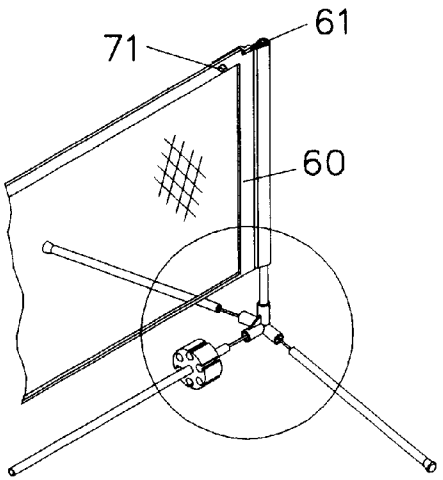
FIG. 3 is a partially assembly view of the net support rack assembly as shown in FIG. 1.
Figures 4, 4A, 4B:
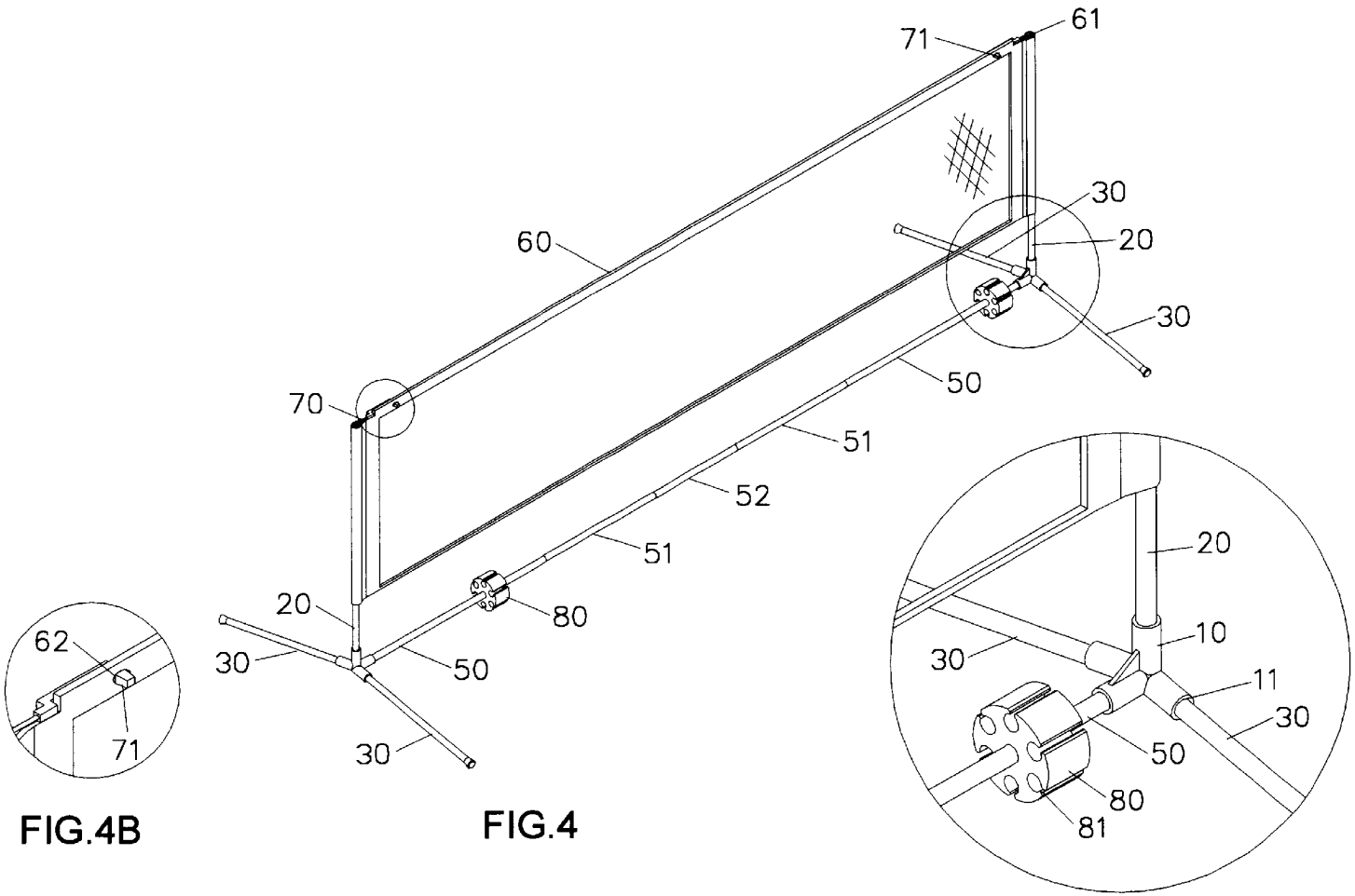
FIG. 4 is a perspective assembly view of the net support rack assembly as shown in FIG. 1.
FIG. 4A is a partially enlarged view of the net support rack assembly as shown in FIG. 4.
FIG. 4B is a partially enlarged view of the net support rack assembly as shown in FIG. 4.

Then, referring to FIGS. 3 and 3A with reference to FIGS. 1 and 1A, the net 60 is mounted on the two longitudinal tubes 20, and the snapping end 71 of the elastic lock 70 is snapped into the hooking groove 62 of the net 60 as shown in FIG. 4B, so that the net 60 is secured on the two longitudinal tubes 20 by the elastic force of the elastic lock 70. Then, the lower end of each of the two longitudinal tubes 20 is inserted into the through hole 11 of the first end of a respective one of the two connectors 10.

Figure 5:
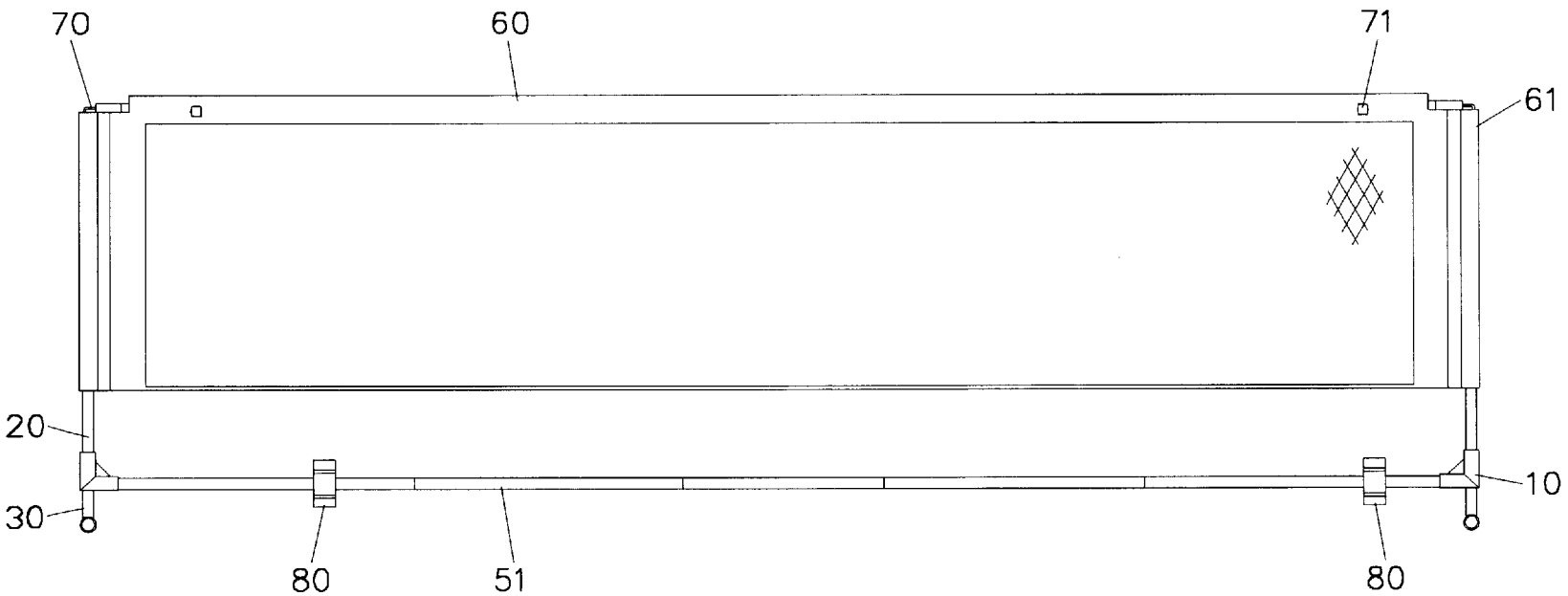
FIG. 5 is a front plan assembly view of the net support rack assembly as shown in FIG. 1.

As shown in FIGS. 4, 4A and 5, the net support rack assembly in accordance with the first embodiment of the present invention is assembled.

Figure 6:
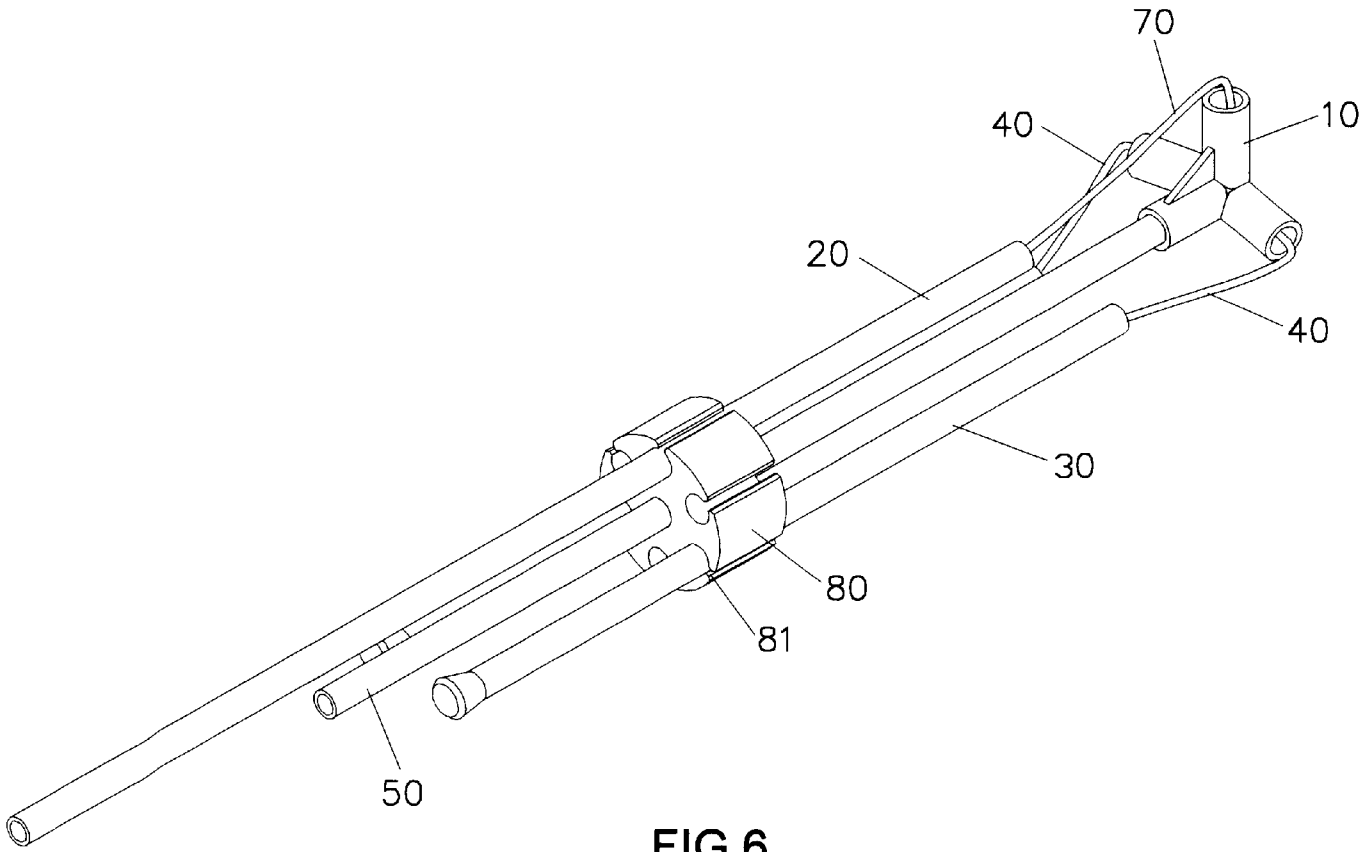
FIG. 6 is a perspective folded view of the net support rack assembly as shown in FIG. 4.

Referring to FIG. 6 with reference to FIGS. 1 and 1A, the snapping end 71 of the elastic lock 70 is detached from the hooking groove 62 of the net 60. The snapping end 71 of the elastic lock 70 has a size slightly greater than the inner diameter of each of the two longitudinal tubes 20, so that the snapping end 71 of the elastic lock 70 is rested on the upper end of each of the two longitudinal tubes 20. Then, the net 60 is detached from the two longitudinal tubes 20. Then, each of the two longitudinal tubes 20 and each of the four transverse tubes 30 are pulled outward from the through hole 11 of each of the two connectors 10, and are inserted into and locked in one of the clamping recesses 81 of each of the two clamping members 80. Then, each of the two bottom tubes 50, each of the two first connecting tubes 51 and the second connecting tube 52 are detached from each other, thereby folding the net support rack assembly in accordance with the present invention.

Figure 7:
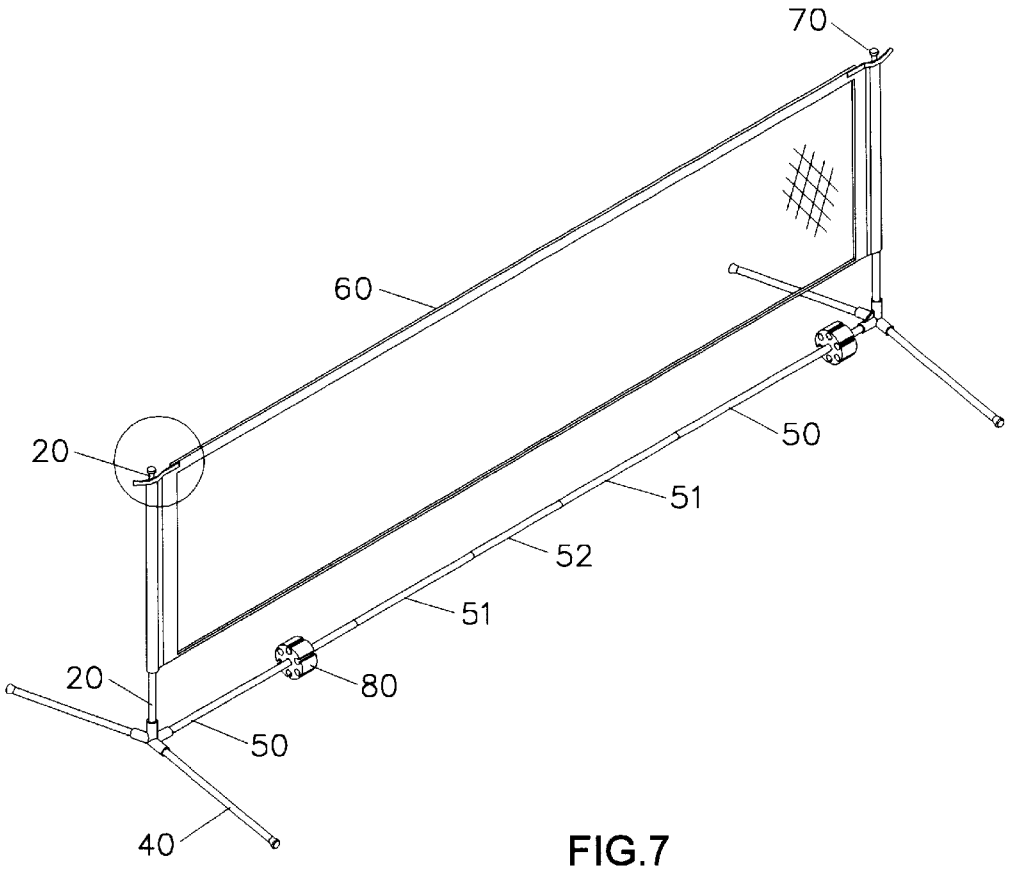
FIG. 7 is a perspective view of a net support rack assembly in accordance with a first embodiment of the present invention.
Figure 7A:
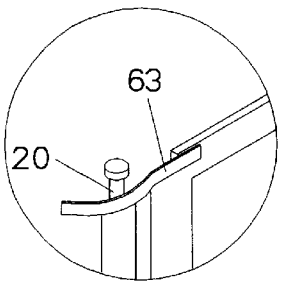
FIG. 7A is a partially enlarged view of the net support rack assembly as shown in FIG. 7.

Referring to FIGS. 7 and 7A, a net support rack assembly in accordance with a second embodiment of the present invention is shown, wherein the hooking groove 62 of the net 60 and the snapping end 71 of the elastic lock 70 are undefined, and the net 60 has two sides each provided with an adhesive tape 63 mounted on the upper end of each of the two longitudinal tubes 20. In addition, each of the two free ends of the elastic lock 70 has a size slightly greater than the inner diameter of each of the two longitudinal tubes 20, thereby preventing the elastic lock 70 from retracting into each of the two longitudinal tubes 20.

Accordingly, the net support rack assembly in accordance with the present invention has the following advantages.

1. The snapping end 71 of the elastic lock 70 is snapped into the hooking groove 62 of the net 60, so that the net 60 is fully stretched and expanded on the two longitudinal tubes 20 by the elastic force of the elastic lock 70.

2. Each of the two longitudinal tubes 20, each of the two connectors 10, each of the two bottom tubes 50, each of the two first connecting tubes 51 and the second connecting tube 52 are closely combined with each other by the elastic force of the elastic lock 70.

3. Each of the transverse tubes 30 is closely mounted on a respective one of the two connectors 10 by the elastic force of each of the two elastic cords 40.

4. Each of the two clamping members 80 is movably mounted on the bottom tube 50 to provide a positioning effect, thereby preventing the bottom tube 50 from being bent.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A net support rack assembly comprising two connectors, two longitudinal tubes, four transverse tubes, two elastic cords, two bottom tubes, two first connecting tubes, a second connecting tube, a net, and an elastic lock, wherein:

each of the two connectors has a hollow inside and has four ends each formed with a through hole;

each of the two longitudinal tubes has a lower end inserted into the through hole of a first end of a respective one of the two connectors;

each of the four transverse tubes has a first end inserted into the through hole of either one of second and third ends of a respective one of the two connectors;

each of the two elastic cords is extended through the through hole of each of the second and third ends of a respective one of the two connectors and two of the four transverse tubes, and has two ends each secured on a second end of a respective one of the four transverse tubes, so that the first end of each of the four transverse tubes is closely mounted in the through hole of either one of the second and third ends of a respective one of the two connectors by the elastic force of each of the two elastic cords;

each of the two bottom tubes has a first end inserted into the through hole of a fourth end of a respective one of the two connectors;

each of the two first connecting tubes has a first end connected to a second end a respective one of the two bottom tubes;

the second connecting tube has two ends each connected to a second end a respective one of the two first connecting tubes;

the net has two sides each formed with an enclosure to enclose a respective one of the two longitudinal tubes;

the elastic lock is extended through each of the two longitudinal tubes, each of the two connectors, each of the two bottom tubes, each of the two first connecting tubes and the second connecting tube, so that each of the two longitudinal tubes, each of the two connectors, each of the two bottom tubes, each of the two first connecting tubes and the second connecting tube are combined with each other by the elastic force of the elastic lock and the net support rack assembly further comprises two clamping members each mounted on a respective one of the two bottom tubes and each formed with a plurality of clamping recesses for clamping the two longitudinal tubes and the four transverse tubes when they are folded.

2. The net support rack assembly in accordance with claim 1, wherein each of the two sides of the net is formed with a hooking groove, and the elastic lock has two ends each formed with a snapping end snapped into the hooking groove of the net.

3. The net support rack assembly in accordance with claim 2, wherein the snapping end of the elastic lock has a size slightly greater than an inner diameter of each of the two longitudinal tubes.

4. The net support rack assembly in accordance with claim 1, wherein the net has two sides each provided with an adhesive tape mounted on the upper end of each of the two longitudinal tubes.

5. The net support rack assembly in accordance with claim 1, wherein each of the two free ends of the elastic lock has a size slightly greater than the inner diameter of each of the two longitudinal tubes, thereby preventing the elastic lock from retracting into each of the two longitudinal tubes.

* * * * *